US008631779B2

(12) United States Patent
Abe

(10) Patent No.: US 8,631,779 B2
(45) Date of Patent: Jan. 21, 2014

(54) INTERNAL COMBUSTION ENGINE WITH KICK STARTER

(75) Inventor: Katsuya Abe, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 867 days.

(21) Appl. No.: 12/723,311

(22) Filed: Mar. 12, 2010

(65) Prior Publication Data

US 2010/0242890 A1 Sep. 30, 2010

(30) Foreign Application Priority Data

Mar. 31, 2009 (JP) ..... 2009-088249

(51) Int. Cl.
*F02N 3/04* (2006.01)

(52) U.S. Cl.
USPC ..... 123/185.1; 123/179.24

(58) Field of Classification Search
USPC ..... 123/179.24, 185.1, 185.5, 185.6
See application file for complete search history.

(56) References Cited

U.S. PATENT DOCUMENTS

| | | | | |
|---|---|---|---|---|
| 2,841,989 | A * | 7/1958 | Kreidler et al. | 123/185.5 |
| 4,934,210 | A * | 6/1990 | Suzuki | 74/512 |
| 5,038,731 | A * | 8/1991 | Shimada | 123/192.2 |
| 5,065,644 | A * | 11/1991 | Shimada | 123/192.2 |
| 7,201,686 | B2 * | 4/2007 | Masuda et al. | 180/230 |
| 7,240,646 | B2 * | 7/2007 | Watanabe et al. | 123/48 B |
| 7,900,733 | B2 * | 3/2011 | Miyabe | 180/219 |
| 2002/0043237 | A1 * | 4/2002 | Nomura et al. | 123/196 R |
| 2008/0096718 | A1 * | 4/2008 | Oishi et al. | 477/44 |

FOREIGN PATENT DOCUMENTS

| | | | |
|---|---|---|---|
| CN | 1932259 | A | 3/2007 |
| JP | 02-191867 | A | 7/1990 |
| JP | 03-229964 | A | 10/1991 |
| JP | 05-213262 | A | 8/1993 |
| JP | 2566241 | B | 10/1996 |
| JP | 2000-034933 | A | 2/2000 |
| JP | 2003-293786 | A | 10/2003 |
| JP | 2007-022098 | A | 2/2007 |
| JP | 2007-146801 | A | 6/2007 |
| WO | WO 2004/111409 | A1 | 12/2004 |
| WO | WO 2005/007499 | A1 | 1/2005 |

* cited by examiner

*Primary Examiner* — Stephen K Cronin
*Assistant Examiner* — Arnold Castro
(74) *Attorney, Agent, or Firm* — Birch, Stewart, Kolasch & Birch, LLP

(57) ABSTRACT

An internal combustion engine with a kick starter for ensuring layout flexibility of a kick shaft while suppressing an enlargement of the engine. An output shaft is disposed at a position overlapped with a driven pulley from a side view. A power transmission mechanism is disposed between the output shaft and the driven shaft pulley in a crankcase. A kick shaft is disposed at a position below and forward of the driven pulley shaft, which is not overlapped with the driven pulley from the side view. A kick intermediate shaft is disposed between the kick shaft and the crankshaft such that the kick starter is mounted on the crankcase.

19 Claims, 11 Drawing Sheets

INTERNAL COMBUSTION ENGINE WITH KICK STARTER

CROSS-REFERENCE TO RELATED APPLICATIONS

The present application claims priority under 35 USC 119 to Japanese Patent Application No. 2009-088249 filed on Mar. 31, 2009 the entire contents of which are hereby incorporated by reference.

BACKGROUND OF THE INVENTION

1. Field of the Invention

The present invention relates to an internal combustion engine with a kick starter.

2. Description of Background Art

An internal combustion engine mounted on a vehicle includes a crankshaft supported with a crankcase, a transmission mounted on one side of the crankshaft, a generator mounted on the other side of the crankshaft, a power transmission mechanism for transmitting a rotation of gears shifted by the transmission, and a kick starter which allows a kick shaft to rotate the crankshaft. The transmission includes a drive pulley mounted on one side of the crankshaft, a driven pulley mounted on one side of a driven shaft supported to the rear of the crankshaft, and a belt set between the drive pulley and the driven pulley. The power transmission mechanism includes a reduction gear for decelerating the rotation of the driven shaft so as to be transmitted to the output shaft. See, for example, JP-A No. H5-213262.

The above-structured engine includes the kick shaft (kick spindle) on the line for connecting the crankshaft and the output shaft between the generator and the power transmission mechanism from a side view. A kick drive gear mounted on the kick shaft is in mesh with the gear of the generator rotor outside the generator. Accompanied with rotation of the kick shaft, the generator rotor rotates, by which the crankshaft connected thereto is rotated.

In the generally employed structure, the generator and the power transmission mechanism are mounted on the other side of the engine, which may restrict the arrangement of the kick drive gear to be disposed outside the generator. As the kick drive gear is mounted outside the generator and in mesh with the gear of the generator rotor, the diameter of the kick drive gear becomes large. As a result, the engine overhangs in the width direction by the amount corresponding to the generator and kick drive gear arranged in the width direction.

A relatively small engine such as the one used on a motorcycle has the size (outline) defined by each diameter of the drive pulley and the driven pulley. In order to store the kick drive gear with a large diameter in the engine case, the position of the kick shaft as the spindle of the kick drive gear is limited. As disclosed in JP-A No. H5-213262, the layout of the crankshaft, kick shaft and output shaft is limited to the linear arrangement at intervals in the longitudinal direction for the purpose of suppressing an enlargement of the engine.

SUMMARY AND OBJECTS OF THE INVENTION

The present invention has been made in consideration of the aforementioned circumstances to provide an internal combustion engine with kick starter which ensures layout flexibility of the kick shaft while suppressing AN enlargement of the engine.

According to an embodiment of the present invention, an internal combustion engine with a kick starter is provided with a crankcase, a crankshaft supported with the crankcase, a transmission mounted on one side of the crankshaft, a generator mounted on the other side of the crankshaft, and a power transmission mechanism for transmitting rotation of gears shifted by the transmission to an output shaft supported with the crankcase. The transmission includes a drive pulley mounted on one side of the crankshaft, a driven pulley mounted on one side of a driven shaft supported to a rear of the crankshaft, and a belt set between the drive pulley and the driven pulley. The power transmission mechanism is provided with a reduction gear for decelerating the rotation of the driven shaft to be transmitted to the output shaft, a kick shaft which extends from the other side into the crankcase, and a kick starter for rotating the crankshaft with the kick shaft. The output shaft is disposed at a position overlapped with the driven pulley from a side view, and the power transmission mechanism is disposed between the output shaft and the driven shaft in the crankcase. The kick shaft is disposed at a position below and forward of the driven shaft, which is not overlapped with the driven pulley from the side view, and a kick intermediate shaft is disposed between the kick shaft and the crankshaft to mount the kick starter on the crankcase.

According to an embodiment of the present invention, the output shaft is located at a position overlapped with the driven pulley from the side view. The power transmission mechanism is disposed between the output shaft and the driven shaft in the crankcase. The kick shaft is located at a position below and forward of the driven shaft, which is not overlapped with the driven pulley from the side view. The kick intermediate shaft is located between the kick shaft and the crankshaft, and the kick starter is disposed in the crankcase to ensure the layout flexibility of the kick shaft while suppressing an enlargement of the engine.

In the aforementioned structure, the kick intermediate shaft may include a first kick intermediate shaft provided with a kick driven gear in mesh with a kick drive gear mounted on the kick shaft and a first idle gear, and a second kick intermediate shaft provided with a second idle gear in mesh with the first idle gear and a kick starter gear in mesh with the crankshaft. A line for connecting the kick shaft and the crankshaft may intersect a line for connecting the first kick intermediate shaft and the second kick intermediate shaft from the side view. In the above-described structure, the kick shaft and the crankshaft may be adjacently arranged, and the space therebetween may be efficiently used to allow the kick intermediate shaft to be arranged so as to avoid enlargement of the engine.

In the above-described structure, the kick drive gear and the kick starter gear may be disposed to be overlapped with each other from the side view. The structure allows the longitudinal space and vertical space required for arranging the kick drive gear and the kick starter gear to be reduced, thus avoiding an enlargement of the engine.

The structure allows the output shaft to be disposed to a rear of the driven shaft, and a spindle of the reduction gear which forms the power transmission mechanism to be located above the output shaft. The structure allows a spindle of the reduction gear which forms the power transmission mechanism to be interposed between the output shaft and the kick shaft. The structure allows the output shaft to be located in the range except the upper side of the crankcase so as to be in the space with the diameter of the driven pulley. The structure also allows effective use of the space between the output shaft and the kick shaft.

The aforementioned structure allows an oil sump which extends downward to be formed at a lower portion of the crankcase, and the kick shaft to be disposed in the oil sump. The kick shaft may be easily lubricated with oil.

The aforementioned structure allows a clutch to be interposed between the crankcase and the transmission, an oil sump to be formed at a lower portion of the transmission case for covering the clutch, and a step bar support portion for supporting a step bar to be supported with the oil sumps of the crankcase and the transmission case. The aforementioned structure ensures a wider support interval between left and right sides of the step bar compared with the support structure only with the crankcase.

According to an embodiment of the present invention, the output shaft is located at the position overlapped with the driven pulley from the side view, and the power transmission mechanism is located between the output shaft and the driven shaft in the crankcase. The kick shaft is located at a position below and forward of the driven shaft, which is not overlapped with the driven pulley from the side view. The kick intermediate shaft is disposed between the kick shaft and the crankshaft for mounting the kick starter on the crankcase. This makes it possible to ensure the layout flexibility of the kick shaft while suppressing an enlargement of the engine.

The kick intermediate shaft includes a first kick intermediate shaft and a second kick intermediate shaft. As the line for connecting the kick shaft and the crankshaft intersects the line for connecting the first and the second kick intermediate shafts from the side view, the kick shaft and the crankshaft may be arranged adjacent to each other. The kick intermediate shaft may be disposed efficiently using the space between the kick shaft and the crankshaft, thus avoiding an enlargement of the engine.

The kick drive gear and the kick starter gear are arranged to be overlapped from the side view. This makes it possible to reduce the longitudinal space and vertical space required for arranging those gears, thus avoiding an enlargement of the engine.

The output shaft is located to the rear of the driven shaft, and the spindle of the reduction gear for forming the power transmission mechanism is located above the output shaft. The output shaft may be located in the range except the upper side of the crankcase. For example, it may be located in the space inside the diameter of the driven pulley of the output shaft so as to be in the unoccupied space to form the compact structure without being overlapped with the space for arranging the kick shaft.

The spindle of the reduction gear for forming the power transmission mechanism is located between the output shaft and the kick shaft to allow efficient use of the space therebetween.

An oil sump extends downwardly and is formed at the lower portion of the crankcase, having the kick shaft therein. The use of the kick shaft and the kick starter gear makes it possible to easily lubricate the kick shaft with oil without enlarging the case diameter.

The clutch is disposed between the crankcase and the transmission, and the oil sump is formed at the lower portion of the transmission case for covering the clutch. Step bar support portions for supporting step bars are provided for the oil sumps of the crankcase and the transmission case, respectively. So the support interval between the left and right sides of the step bar may be ensured to be wider than the support structure only with the crankcase, thus allowing the support while ensuring rigidity.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

An embodiment according to the present invention will be described referring to the accompanied drawings.

In the specification, descriptions with respect to the direction, for example, the longitudinal, left and right, and vertical directions correspond to those of the vehicle. Arrow marks F, R and U indicate the front, right and upward directions of the vehicle body, respectively.

Figure 1:
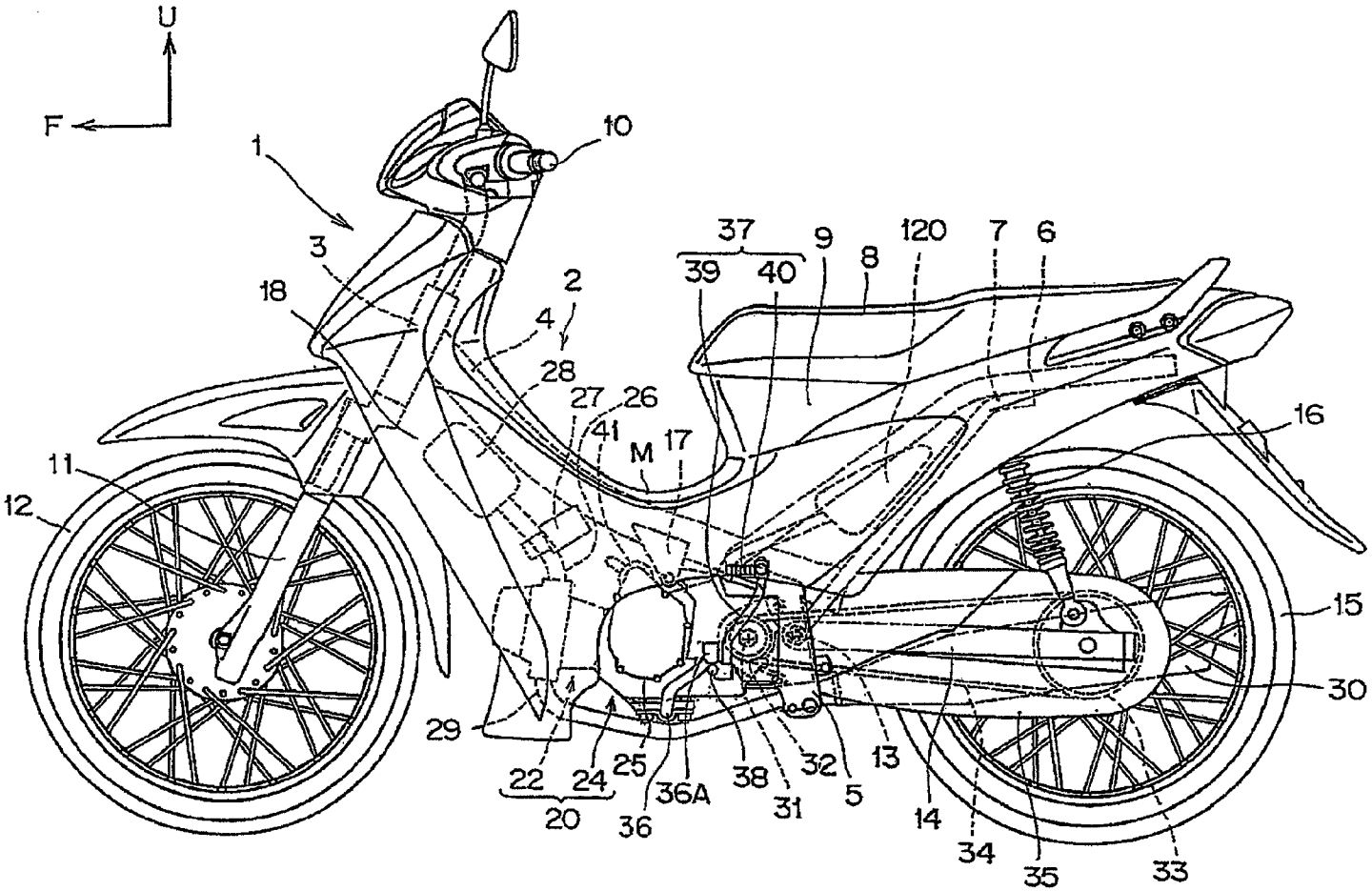
FIG. 1 is a side view of a motorcycle to which the embodiment of the present invention is applied.

FIG. 1 is a side view illustrating a motorcycle 1 to which the embodiment of the present invention is applied.

A vehicle frame 2 of the motorcycle 1 includes a head pipe 3 in the front of the vehicle, a single main frame 4 which obliquely extends in a diagonal downward direction to the rear of the head pipe 3 and a pair of left and right pivot brackets 5 extends downward to the rear of the main frame 4 so as to be fixed. A pair of left and right seat rails 6 extends in a diagonal upward direction to the rear of the main frame 4 from the location around the front of the position to which the pivot bracket 5 is fixed at the rear portion of the main frame 4 and are then bent to reach the rear end. A pair of left and right reinforcing frames 7 for reinforcing the portion is provided between the pivot bracket 5 and the center of the seat rail 6.

A seat 8 is disposed above the pair of left and right seat rails 6 of the vehicle frame 2. A storage unit (storage box) 9 is disposed below the seat 8. A handlebar 10, journaled to the head pipe 3, is disposed at the upper front portion of the vehicle. Front forks 11, 11 extend below the handlebar 10. A front wheel 12 is journaled to the lower ends of the front forks. A rear fork 14 extends rearward with the front end swingably journaled to a pivot shaft 13. A rear wheel 15 is journaled to the rear end of the rear fork 14. A pair of left and right rear shock absorbers 16 is interposed between the rear end portions of the rear fork 14 and the seat rails 6.

An engine as an internal combustion engine (or power unit) 20 is suspended below the main frame 4 to the front of the pivot bracket 5. A top portion of the engine 20 is suspended with a support bracket 17 which is hung at a center of the main frame 4. A rear end portion of the engine 20 is fixed to the pivot bracket 5 at two positions. In other words, the engine 20 is supported while being hung at the rear lower side of the main frame 4. The vehicle frame 2 is covered with a vehicle cover 18 which is formed of a synthetic resin material and separated into the respective sections.

The engine 20 is a single-cylinder 4-cycle air-cooled engine, which is formed into a horizontal engine having a cylinder 22 largely tilted forward from the front surface of a crankcase 24 to nearly a horizontal state. This makes it possible to lower the center of gravity of the vehicle and lower the height of a saddle M straddled by the rider of the vehicle, resulting in improved accessibility. A generator cover 25 is mounted on the front left side surface of the crankcase 24. Referring to FIG. 1, the vehicle cover 18 is formed to cover the vehicle body to the portion around the outer edge of the crankcase 24 from the side view of the vehicle such that the side surface of the crankcase 24 including the generator cover is exposed outside.

An intake pipe 26 is connected to the upper side of the cylinder 22 of the engine 20, and extends upward to be connected to a throttle body 27 with an air cleaner 28 supported with the main frame 4. An exhaust pipe 29 is connected to the lower side of the cylinder 22. The exhaust pipe 29 extends downward and then is bent to further extend rearward so as to be connected to a muffler 30 to the right of the rear wheel 15.

An output shaft 31 of the engine 20 is journaled to a rear left side surface of the crankcase 24 while having the top end exposed. A drive sprocket 32 is attached to the top end of the output shaft 31. A power transmission chain 34 (see FIG. 1) is wound between the drive sprocket 32 and a driven sprocket 33 integrally formed with the rear wheel 15 to form a chain transmission mechanism. The rotation of the output shaft 31 of the engine 20 is transmitted to the rear wheel 15 via the chain transmission mechanism. The chain transmission mechanism serves as a secondary reduction mechanism for setting the reduction gear ratio (secondary reduction gear ratio) between the output shaft 31 and the rear wheel shaft based on the ratio of the number of gear teeth between the sprockets 32 and 33. A cover 35 for the chain transmission mechanism is provided.

A step bar 36 extends laterally with respect to the vehicle body and is provided at the lower portion of the crankcase 24. A pair of steps 36A, 36A on which the rider's feet rest is provided at both ends of the step bar 36.

The motorcycle 1 includes a kick member (starter member) 37 which partially forms a kick starter 140 for starting the engine 20 disposed to the left of the crankcase 24. That is, the kick member 37 includes a kick arm 39 mounted on a kick shaft 38 journaled to the crankcase 24 while having the top end exposed, and a kick pedal 40 rotatably attached to the top end of the kick arm 39. Upon pressing down of the kick pedal 40 by the rider, the kick shaft 38 is rotated to start the engine 20.

In addition to the kick starter 140, the motorcycle 1 includes a starter motor 41 for starting the engine. The starter motor 41 is mounted on the front upper surface of the crankcase 24. The engine 20 may be started by activating the starter motor 41. The motorcycle 1 is structured to start the engine 20 by either the kick starter or the starter motor.

Figure 2:
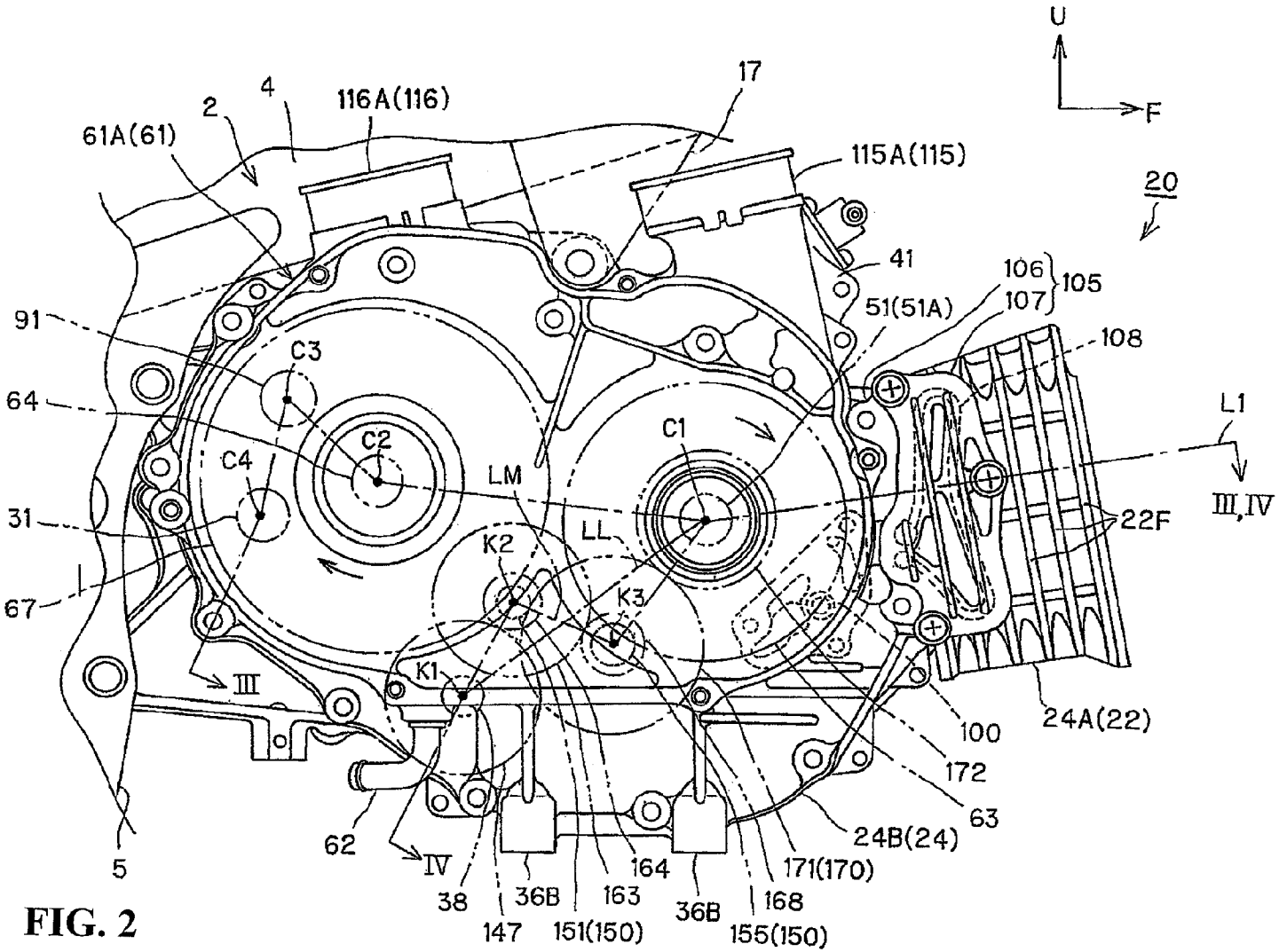
FIG. 2 is a right side view illustrating an inner structure of an engine of the motorcycle.
Figure 3:
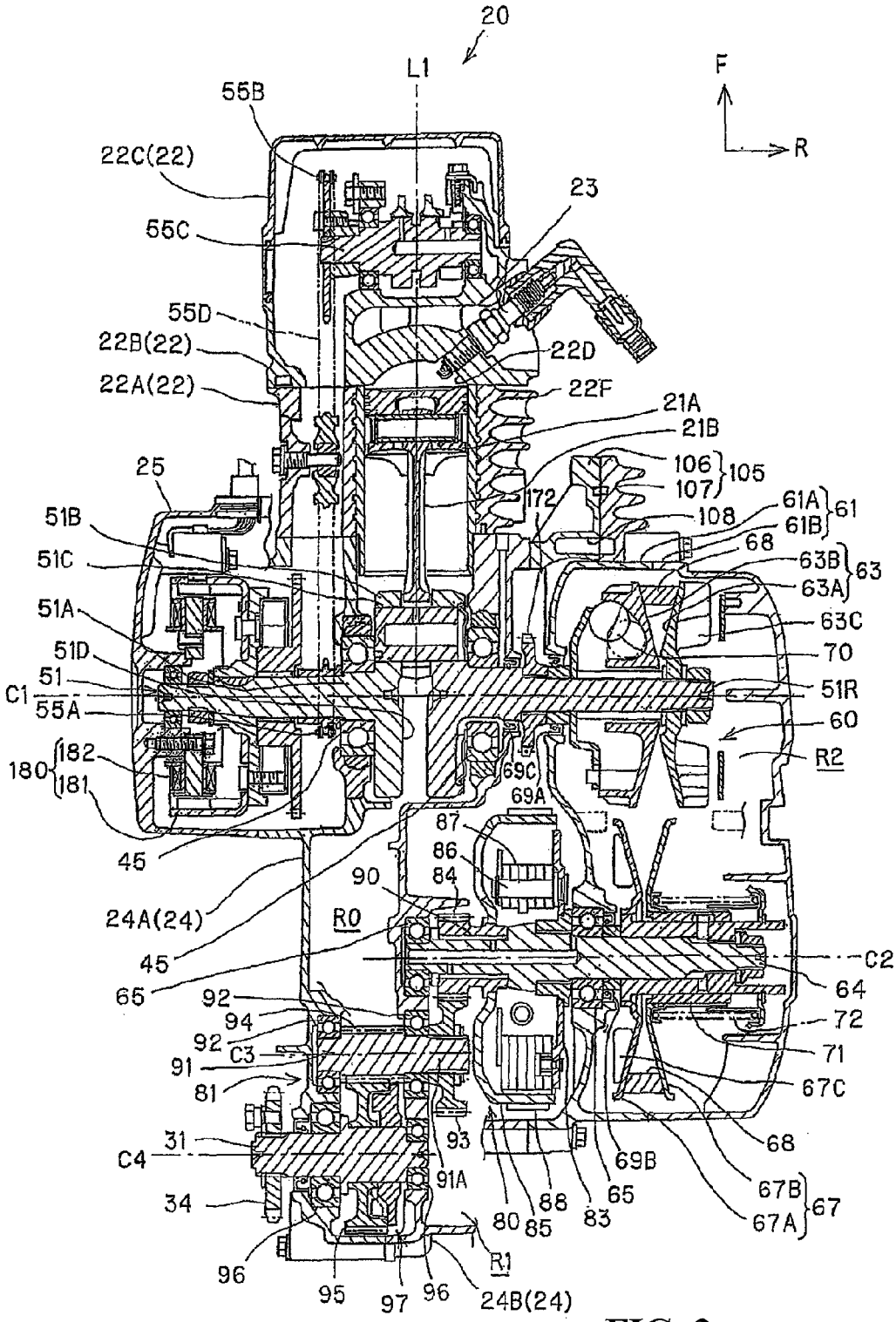
FIG. 3 is a sectional view taken along line shown in FIG. 2.

FIG. 2 is a right side view of an inner structure of the engine 20 illustrating each position of the main rotary shafts in the power transmission system and the starter system together with a cylinder axis L1. FIG. 3 is a sectional view taken along line of FIG. 2.

Referring to FIGS. 2 and 3, the cylinder 22 of the engine 20 includes a cylinder block 22A connected to the front surface of the crankcase 24, a cylinder head 22B connected to the front surface of the cylinder block 22A, and a head cover 22C for covering the front surface of the cylinder head 22B. The cylinder head 22B is provided with a combustion chamber 22D, and not shown intake and exhaust ports which are connected to the combustion chamber 22D. A spark plug 23 is disposed so as to have the top end directed to the combustion chamber 22D. The intake pipe 26 is connected to an intake port inlet, and the exhaust pipe 29 is connected to an exhaust port outlet. Referring to FIG. 2, a radiation fin 22F is provided in the cylinder 22 so as to be air cooled.

Referring to FIG. 3, the crankcase 24 of the engine 20 is formed as a two-left/right-split structure, that is, a left crankcase 24A and a right crankcase 24B. A crankshaft 51 has its axial center C1 journaled to the front of the crankcase 24 sideways while intersecting the vehicle traveling direction via a pair of left and right bearings (roller bearings) supported with the left and right crankcases 24A and 24B.

The crankshaft 51 includes a crank journal 51A as a rotating center, a crank web 51B with a diameter larger than that of the crank journal 51A, and a crank pin (eccentric shaft) 51C supported via the crank web 51B. The crank web 51B and the crank pin 51C are interposed between the left and right bearings 45, 45. The crank web 51B is provided with a balance weight (hereinafter referred to as a weight) 51D for balancing the rotation.

A piston 21A slidably disposed inside the cylinder 22 along the cylinder axis L1 is connected to the crank pin 51C of the crankshaft 51 via a connecting rod 21B. Referring to FIG. 3, a sprocket 55A is mounted on the crankshaft 51 and a sprocket 55B is mounted on a camshaft 55C inside the head cover 22C of the cylinder 22, respectively. The sprockets 55A and 55B are connected via a cam chain 55D. The cam shaft 55C rotates accompanied with the rotation of the crankshaft 51 so as to drive the valve mechanism for pressing the not shown intake/exhaust valves attached to the cylinder head 22B.

A belt type continuously variable transmission 60 is disposed at the right side (one side) of the crankshaft 51, and a generator 180 is disposed at the left side (the other side) of the crankshaft 51.

More specifically, the left end of the crankshaft 51 extends to the left in the left crankcase 24A and further extends to the position around the generator cover 25 attached to cover the left opening (outer opening) of the left crankcase 24A. The generator 180 is stored in the space defined by the generator cover 25 and the left crankcase 24A. The generator 180 includes a rotor 181 fixed to the crankshaft 51, and a stator 182 disposed inside the rotor 181. The stator 182 is fixed to the generator cover 25.

The belt type continuously variable transmission 60 is a dry type power transmission mechanism which is not lubricated with engine oil, which is stored in a transmission storage section 61 at the right side (one side) of the crankshaft 51. The transmission storage section 61 forms a chamber to which no fluid is supplied separately from that of the crankcase 24 lubricated with the engine oil, and has a two-left/right-split type structure including a transmission case 61A for forming a main body of the transmission storage section 61 and a transmission cover (cover member) 61B for covering the outer opening (right opening) of the transmission case 61A.

More specifically, the right end of the crankshaft 51 pierces the right crankcase 24B to further extend to the right, and pierces the transmission case 61A connected to the right side of the right crankcase 24B with bolt to further extend to the portion around the transmission cover 61B continuously connected to the transmission case 61A. The right end portion is used as a drive pulley shaft (drive shaft) 51R for the belt type continuously variable transmission 60, on which the drive pulley 63 is mounted.

A driven pulley shaft (driven shaft) 64 of the belt type continuously variable transmission 60 is journaled to the rear portion of the crankcase 24 sideways while having the axial center C2 (see FIG. 2) intersecting the vehicle traveling direction. The driven pulley shaft 64 is in parallel with the rear side of the drive pulley shaft 51R, and is journaled via a pair of left and right bearings (roller bearings) 65, 65 supported with the right crankcase 24B and the transmission storage section 61 (transmission case 61A).

The driven pulley shaft 64 is provided with a driven pulley 67 having a V-belt 68 set therebetween such that the rotation of the drive pulley 63 is transmitted to the driven pulley 67. Seal members 69A and 69B for blocking inflow of the engine oil at the crankcase 24 into the transmission storage section 61 are interposed among the transmission storage section 61, the pulley shafts 51R and 64, respectively. The transmission storage section 61 is sealed from the crankcase 24.

The drive pulley 63 includes a fixed half-body 63A and a movable half-body 63B which rotate together with the drive pulley shaft 51R. The fixed half-body 63A is fixed to the drive pulley shaft 51R, and the movable half-body 63B is movably fixed to the left of the fixed half-body 63A in the axial direction. The movable half-body 63B rotates together with the crankshaft 51, and is allowed to axially slide by a weight roller 70 which is moved under the centrifugal force to the centrifugal direction so as to approach to or move away from the fixed half-body 63A. As a result, the winding diameter of the V-belt 68 set between the pulley half-bodies 63A and 63B is changed.

The driven pulley 67 of the belt type continuously variable transmission 60 includes a fixed half-body 67A and a movable half-body 67B which rotate together with the driven pulley shaft 64. The fixed half-body 67A is fixed at the left side of the movable half-body 67B. The movable half-body 67B is movably disposed at the right end of the driven pulley shaft 64 in the axial direction via an annular slider 71, and is urged leftward (side of the fixed half-body 67A) by an urging member 72 as a coil spring. When the winding diameter of the V-belt 68 set between the half-bodies 63A and 63B of the drive pulley 63 becomes large, the distance between the half-bodies 67A and 67B of the driven pulley 67 extends against the urging force of the coil spring 72. As a result, the winding diameter of the V-belt 68 is reduced to automatically perform as a continuously variable transmission.

The driven pulley shaft 64 transmits power to the power transmission mechanism 81 disposed inside the crankcase 24 via a centrifugal clutch 80 in the space defined by the right crankcase 24B and the transmission case 61A (clutch chamber R1 to be described below).

The centrifugal clutch 80 is a wet type clutch having respective portions lubricated and cooled with the engine oil, and includes a clutch inner 83 splined to the driven pulley shaft 64, and a clutch outer 85 connected to a clutch output gear 84 which is relatively rotatably attached to the left end of the driven pulley shaft 64. Plural spindles 86 which protrude from the outer circumferential end side of the clutch inner 83 are provided with a clutch weight 87. When the rotating speed of the driven pulley shaft 64 exceeds the predetermined speed, the clutch weight 87 which moves toward the centrifugal direction under the centrifugal force is engaged with the clutch outer 85. Then the clutch outer 85 is rotated together with the driven pulley shaft 64 to rotate the clutch output gear 84.

Referring to the drawing, a clutch reinforcing plate 88 is provided for suppressing the extension of the clutch outer 85 in the centrifugal direction. A retainer 90 is disposed between the clutch output gear 84 and the driven pulley shaft 64. The retainer 90 includes two lines in the axial direction each having bearing rollers arranged at intervals in the circumferential direction. The two lines of rollers allow the clutch output gear 84 to relatively rotate with respect to the driven pulley shaft 64.

The power transmission mechanism 81 performs power transmission between the belt type continuously variable transmission 60 and the output shaft 31 of the engine 20, and serves as a primary reduction mechanism. The power transmission mechanism 81 is disposed between the driven pulley shaft 64 and the output shaft 31, and includes an intermediate gear shaft (reduction gear shaft) 91 for decelerating the rotation of the clutch output gear 84 mounted on the driven pulley shaft 64 to the predetermined reduction gear ratio to be transmitted to the output shaft 31. Referring to FIG. 2, reference codes C3 and C4 denote axial centers of the intermediate gear shaft 91 and the output shaft 31, respectively.

The intermediate gear shaft 91 is rotatably journaled to a pair of left and right bearings (roller bearings) 92, 92 supported with the left and right crankcases 24A, 24B, and includes a through shaft section 91A which pierces the wall of the right crankcase 24B. A large diameter intermediate shaft driven gear (reduction gear) 93 in mesh with the clutch output gear 84 mounted on the driven pulley shaft 64 is fixed to the through shaft section 91A. A small diameter intermediate drive gear 94 in mesh with a final gear 95 fixed to the output shaft 31 is fixed to the space between the left and right crankcases 24A and 24B. This makes it possible to transmit the rotation of the clutch output gear 84 located outside the crankcase 24 to the final gear 95 of the output shaft 31 in the crankcase 24 via the intermediate gear shaft 91 at the predetermined reduction ratio.

The output shaft 31 is supported with a pair of left and right bearings (roller bearings) 9*a*, 9*b* supported with the left and right crankcases 24A and 24B. The output shaft 31 is rotatably provided with the final gear 95 such that the rotation of the final gear 95 is transmitted to the output shaft 31 via a gear damper 97.

In the engine 20, a space defined by the right crankcase 24B and the transmission case 61A (hereinafter referred to as clutch chamber R1) is formed adjacent to the right of the space defined by the left and right crankcases 24A and 24B (hereinafter referred to as crank chamber R0). The transmission case 61A is connected to the right crankcase 24B to serve as the clutch case member for forming the clutch case.

The crank chamber R0 and the clutch chamber R1 are chambers where lubrication and cooling with the engine oil are performed. Oil sumps are formed at lower portions of the crankcase 24 and the transmission case 61A, respectively.

A space defined by the transmission case 61A and the transmission cover 61B (hereinafter referred to as transmission chamber R2) is formed adjacent to the right of the clutch chamber R1. The transmission chamber R2 is the chamber where the lubrication and cooling with the engine oil are not performed. In the engine 20, the chamber which allows an inflow of the engine oil is definitely separated from the chamber which does not an allow inflow of the engine oil in the vehicle width direction.

Referring to FIG. 2, an oil pump 100 is disposed inside the crankcase 24 of the engine 20 for supplying the engine oil accumulated in the oil sump of the crankcase 24 to the respective portions of the engine 20. The oil pump 100 located obliquely downward to the front of the crankshaft 51 is driven under the rotating force of the crankshaft 51 resulting from the operation for driving the cam chain to discharge the engine oil. The engine oil is then supplied to the bearings 45, 45 for supporting the crankshaft 51, the valve mechanism (not shown) of the cylinder 22, the centrifugal clutch 80, the power transmission mechanism 81 and the like.

The engine 20 is provided with an extended portion 106 which extends from the engine 20. A radiation fin and an oil passage (oil path) 108 are formed on the extended portion 106 for cooling the oil.

More specifically, the extended portion 106 extends from the transmission case 61A for forming the main body of the transmission storage section 61 to the front side of the vehicle body substantially along the cylinder axis L1 so as to be connected to an oil path cover 107 with a bolt. The substantially annular oil passage 108 and the radiation fin are formed between the extended portion 106 and the oil path cover 107. The radiation fin efficiently cools the oil flowing through the oil passage 108 with an air flow. Each section modulus of the extended portion 106 and the oil path cover 107 becomes high to ensure sufficient rigidity. In other words, the extended portion 106 and the oil path cover 107 serve as a compact oil cooler 105 (see FIGS. 2 and 3) integrated with the engine.

In the aforementioned structure, one of divided oil lines press fed from the oil pump 100 flows through the oil passage (not shown) leading to the cylinder 22 for lubricating the respective portions thereof, and then naturally drops to return to the oil sump at the lower portion of the crankcase 24. The other oil line flows through the oil cooler 105 for lubricating the respective portions of the crankshaft 51 through the oil passage 110 shown in FIG. 3, and then naturally drops to return to the oil sump. It is clearly understood that the oil which has been press fed from the oil pump 100 may be divided after passing through the oil cooler 105.

The kick starter 140 will be described hereinafter.

Figure 4:
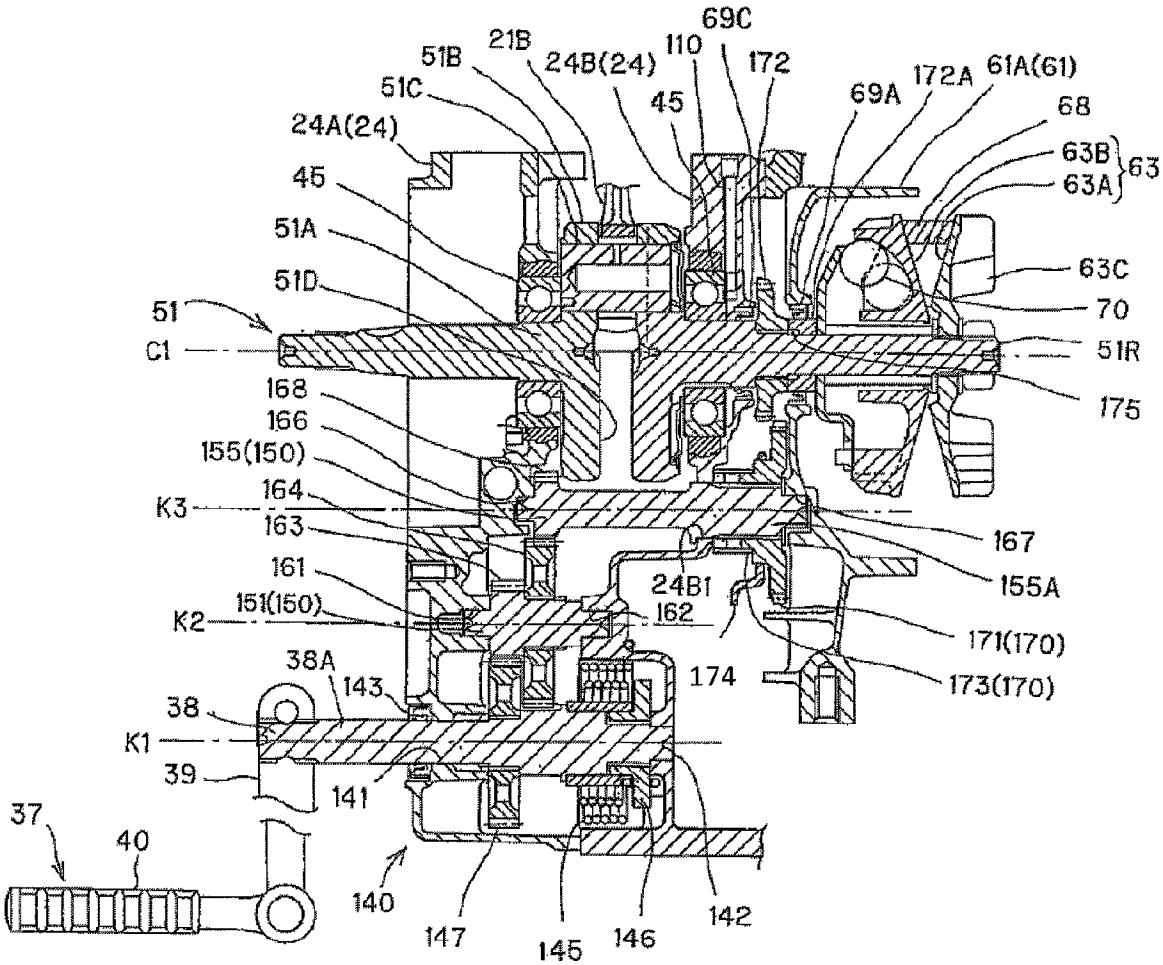
FIG. 4 is a sectional view taken along line IV-IV shown in FIG. 2.

FIG. 4 is a view showing a cross section taken along line IV-IV shown in FIG. 2 for illustrating a mechanism of the kick starter 140 together with the peripheral structure. The kick starter 140 is stored below the engine 20 (mainly below the crankcase 24).

The kick shaft 38 is located at a position below and forward of the driven pulley shaft 64, which is not overlapped with the driven pulley 67 with a large diameter from the side view (see FIG. 2). It is rotatably journaled to bearings (in the embodiment, plain bearing formed as the through hole) 141, 142. The left end of the kick shaft 38 pierces the bearing 141 formed on the wall portion of the left crankcase 24A to project to the left. A proximal end of the kick arm 39 having the top end provided with a kick pedal 40 is fixed to a through shaft 38A. The left crankcase 24A is provided with a seal member 143 for sealing the gap defined with the kick shaft 38. Inside the crankcase 24, a return spring 145 which urges the kick shaft 38 in the direction opposite the direction for kicking the kick shaft 38 and a stopper 146 which stops the kick shaft 38 rotated under the urging force of the return spring 145 at a kick operation start position are provided at the right side of the kick shaft 38. A kick drive gear 147 with a large diameter adjacent to the bearing 141 is provided at the left side of the kick shaft 38.

A kick intermediate shaft 150 for transmitting the rotation of the kick shaft 38 to the crankshaft 51 is disposed between the kick shaft 38 and the crankshaft 51. The kick intermediate shaft 150 of two-shaft structure includes a first kick intermediate shaft 151 driven and rotated by the kick shaft 38 and a second kick intermediate shaft 155 for transmitting the rotation of the first kick intermediate shaft 151 to the crankshaft 51. An axial center of the kick shaft 38 shown in FIG. 2 is designated as a code K1, an axial center of the first kick intermediate shaft 151 is designated as a code K2, and an axial center of the second kick intermediate shaft 155 is designated as a code K3, respectively.

Referring to FIG. 2, the first kick intermediate shaft 151 is located at an intermediate position between the driven pulley shaft 64 and the crank shaft 51 therebelow which is disposed sideways at a position overlapped with the driven pulley 67 with large diameter from the side view. As shown in FIG. 4, it is rotatably journaled to a pair of left and right bearings (in the embodiment, plain bearings formed by the non-through hole) 161, 162 for the left and right crankcases 24A and 24B. The first kick intermediate shaft 151 is completely stored inside the crankcase 24, with which a first kick intermediate driven gear (kick driven gear) 163 with small diameter in mesh with the kick drive gear 147 is integrated. A first kick intermediate shaft drive gear (first idle gear) 164 with a diameter larger than that of the first kick intermediate shaft driven gear 163 is fixed adjacent to the right of the gear 163.

Referring to FIG. 2, the second kick intermediate shaft 155 is located sideways to the rear of the crankshaft 51 therebelow at a position which is not overlapped with the driven pulley 67 with large diameter from the side view. It is rotatably journaled to the pair of left and right bearings (in the embodiment, plain bearings formed as the non-through hole) 166, 167 for the left crankcase 24A and the transmission case 61A, respectively. More specifically, the second kick intermediate shaft 155 is formed as the shaft longer than the first kick intermediate shaft 151 so as to extend through an opening 24B1 formed in the wall portion of the right crankcase 24B while having the left end portion supported with the left crankcase 24A. A shaft portion 155A extends and passes over the space between the crankcase 24 and the transmission case 61A (clutch chamber R1) to be journaled to the transmission case 61A. The shaft portion of the second kick intermediate shaft 155 in the crankcase 24 is integrally formed with the second intermediate shaft driven gear (second idle gear) 168 with a small diameter in mesh with the first kick intermediate shaft drive gear 164 of the first kick intermediate shaft 151. The extended shaft portion 155A of the kick intermediate shaft 155 outside the crankcase 24 is provided with a shift-type gear mechanism 170.

The shift-type gear mechanism 170 is located between the right crankcase 24B and the transmission case 61A, and includes a shift-type gear (kick starter gear) 171 movably mounted on the second kick intermediate shaft 155 in the axial direction, an urging member for urging the shift-type gear 171 against the retracted position which is not in mesh with a kick starter driven gear 172 mounted on the crankshaft 51, and a friction spring 174 wound around the shift-type gear 171 to be supported with the transmission case 61A. As the second kick intermediate shaft 155 rotates upon kicking, the shift-type gear 171 slides to the left to be in mesh with the kick starter driven gear 172. According to the illustrated example, the coil spring is used as the urging member 173. Instead of the coil spring, a leaf spring or a disc spring may be employed.

In the case where the kick pedal 40 is pressed down to rotate the kick shaft 38 against the urging force of the return spring 145, the rotation of the kick shaft 38 is transmitted via the gear lines of the first kick intermediate shaft 151 and the second kick intermediate shaft 155. The shift-type gear 171 is moved toward the direction to be in mesh with the kick starter driven gear 172 to forcibly rotate the crankshaft 51, thus starting the engine 20.

Figure 5:
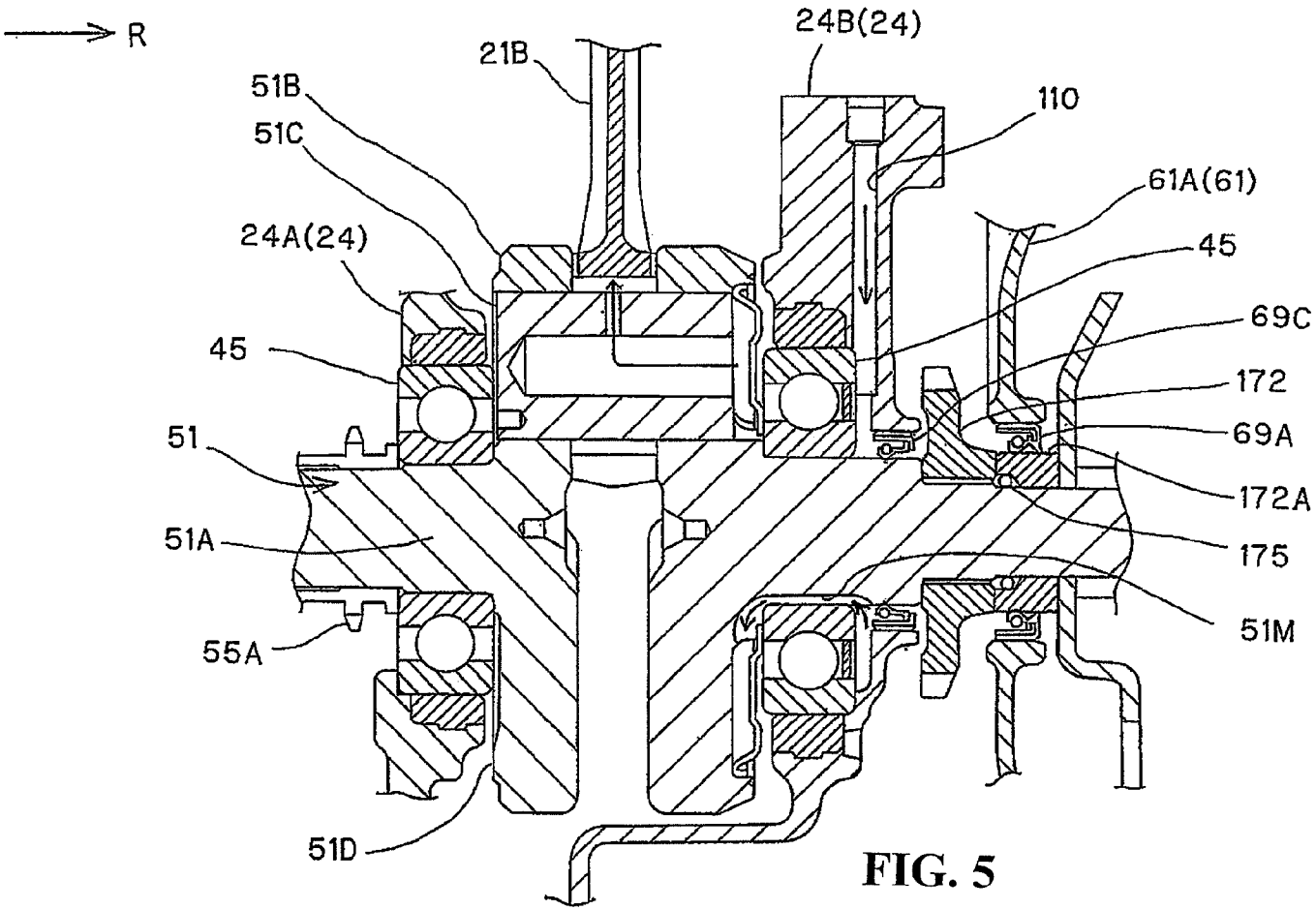
FIG. 5 is a view illustrating a crankshaft and a peripheral structure of the engine.

Referring to FIG. 5, in the structure, the oil passage 110 to which the oil is press fed from the oil pump 100 is formed to supply the oil between the right bearing 45 of the pair of left and right bearings 45 for supporting the crankshaft 51, and a seal member 69C for sealing between the crankshaft 51 and the right crankcase 24B.

The oil discharged from the oil passage 110 passes an oil flow groove 51M formed between the right bearing 45 and the crankshaft 51 to further flow into the crankcase 24. It passes through the oil passage formed in the crank pin 51C to be supplied to a large end portion of the connecting rod 21B.

In the structure, the oil flow groove 51M which allows the oil to pass to the crank pin 51C is formed in the outer circumferential surface of the crankshaft 51 by forming a gap with respect to the right bearing 45 such that the oil is allowed to be supplied to the sliding surface of the connecting rod 21B without forming the oil passage inside the crankshaft 51. Plural oil flow grooves 51M may be formed at intervals in the circumferential direction of the crankshaft 51. Alternatively, the single oil flow groove 51M may be formed long enough to ensure sufficient lubrication.

Referring to FIG. 5, an O-ring 175 is not provided on the inner periphery of the kick starter driven gear 172, but is disposed on the inner periphery of a collar 172A inserted into the crankshaft 51 until it abuts on an end surface of the kick starter driven gear 172.

Assuming that the kick starter driven gear 172 is integrally formed with the collar 172A, the O-ring 175 is disposed on the inner periphery. In this case, care has to be taken to prevent misalignment of the O-ring upon its assembly.

In the structure, the kick starter driven gear 172 is separately formed from the collar 172A, and the O-ring 175 is disposed between those elements. After assembling the O-ring 175 with the crankshaft 51 at the assembly position, the collar 172A may be inserted into the crankshaft 51. This makes it possible to assemble the O-ring 175 easily without causing the misalignment, thus improving ease of assembly.

In the aforementioned case, the gap at the inner periphery of the collar 172A (gap with respect to the crankshaft 51) is sealed with the O-ring 175, and the gap at the outer periphery of the collar 172A (gap with respect to the transmission case 61A) is sealed with the seal member 69A. This makes it possible to ensure sufficient sealing between the transmission storage section 61 and the crankcase 24.

In the engine 20, each diameter of the drive pulley 63 and the driven pulley 67 for forming a main part of the belt type continuously variable transmission 60 is large. In spite of the effort for reducing the size of the engine 20, the longitudinal length and the vertical length required for arrangement of the drive pulley 63 and the driven pulley 67 exceed the predetermined values. The effort for reducing the size of the engine 20 may be realized by keeping the longitudinal and vertical overhang of those pulleys 63 and 67 as least as possible.

In the structure, the kick shaft 38 is disposed at the position below and forward of the driven pulley shaft 64, which is not overlapped with the driven pulley 67 from the left side view. The kick shaft 38 may be disposed by efficiently using the lower space between the driven pulley 67 and the drive pulley 63 from the side view. In other words, the space of the oil sump at the lower portion of the crankcase 24 may be efficiently used for arranging the kick shaft 38. The vertical length of the engine 20 is not increased owing to arrangement of the kick shaft 38.

In the aforementioned arrangement, the kick drive gear 147 mounted on the kick shaft 38 is disposed inside the oil sump. This makes it possible to allow the kick shaft 38 which includes the gear 147 to be lubricated with oil easily without forming the specific structure.

The first kick intermediate shaft 151 and the second kick intermediate shaft 155 which form the kick intermediate shaft 150 are arranged between the kick shaft 38 and the crankshaft 51 in the crankcase 24 (see FIG. 2). The kick intermediate shaft 150 and the intermediate gear mounted thereon may be arranged in the lower space between the driven pulley 67 and the drive pulley 63 (for example, the oil sump) from the side view, thus preventing enlargement of the engine 20. In the aforementioned case, the kick shaft 38, the kick intermediate shaft 150 and the crankshaft 51 are disposed to be adjacent with one another. Each diameter of the gear between the kick shaft 38 and the kick intermediate shaft 150, and the gear between the kick intermediate shaft 150 and the crankshaft 51 may be reduced to prevent enlargement of the engine 20 as well. The gear with small diameter is likely to ensure strength without increasing the width, thus avoiding an increase in the engine width.

In the aforementioned structure, a line LL for connecting the kick shaft 38 and the crankshaft 51 intersects a line LM for connecting the first kick intermediate shaft 151 and the second kick intermediate shaft 155 from the side view. The two kick intermediate shafts 151 and 155 are separately arranged to have the line LL interposed therebetween. The aforementioned layout in the structure allows the two kick intermediate shafts 151 and 155 to be disposed in the small space between the kick shaft 38 and the crankshaft 51. A kicking force transmission path extending from the kick shaft 38 to reach the crankshaft 51 via the kick intermediate shafts 151 and 155 may be reduced, thus allowing each gear mounted on the respective shafts to be made small, thus preventing an enlargement of the engine 20.

The kick starter 140 overhangs downward from the drive pulley 63 and the driven pulley 67 from the side view. However, the overhang portion is located around the oil sump at the lower portion of the crankcase 24, and accordingly, each increase in the vertical length, the longitudinal length, and the width of the engine 20 owing to arrangement of the kick starter 140 may be avoided. The vertical or longitudinal position of the kick shaft 38 may be changed within the space range of the oil sump. This makes it possible to arrange the kick shaft 38 at the position easily kicked by the rider.

Meanwhile, as shown in FIG. 2, the output shaft 31 is located at the position overlapped with the driven pulley 67 from the side view, and the reduction gear (intermediate shaft driven gear 93 and intermediate shaft drive gear 94) is disposed between the output shaft 31 and the driven pulley shaft 64 such that the power transmission mechanism 81 is disposed in the crankcase 24. As a result, the power transmission mechanism 81 may be disposed in the space of the crankcase 24 overlapped with the driven pulley 67 from the side view. The respective components of the power transmission mechanism 81 do not overhang in the longitudinal, vertical and width directions of the pulleys 63 and 67, respectively. This makes it possible to prevent an increase in the vertical length, the longitudinal length and the width of the engine 20.

Referring to FIG. 2, the space overlapped with the driven pulley 67 for accommodating the power transmission mechanism 81 is larger than the space of the oil sump at the lower portion of the engine 20. Accordingly, the respective components of the power transmission mechanism 81 may be appropriately arranged with sufficient margin, and the layout may be changed as well.

According to the embodiment, the output shaft 31 is located at the position overlapped with the driven pulley 67 from the side view, and the power transmission mechanism 81 is interposed between the output shaft 31 and the driven pulley shaft 64 in the crankcase 24. The kick shaft 38 is disposed at the position below and forward of the driven pulley shaft 64, which is not overlapped with the driven pulley 67 from the side view. The kick intermediate shaft 150 is disposed between the kick shaft 38 and the crankshaft 51 to dispose the kick starter 140 in the crankcase 24 so as to ensure the layout flexibility of the kick shaft 38 and the like while suppressing an enlargement of the engine 20. In this case, the position of the kick shaft 38 may be adjusted to the one which allows easy operation in accordance with the vehicle.

The kick intermediate shaft 150 includes the first kick intermediate shaft 151 and the second kick intermediate shaft 155. As the line LL for connecting the kick shaft 38 and the crankshaft 51 intersects the line LM for connecting the first kick intermediate shaft 151 and the second kick intermediate shaft 155, the kick shaft 38 and the crankshaft 51 may be disposed adjacently. In spite of the short distance between the kick shaft 38 and the crankshaft 51, the space therebetween may be efficiently used for accommodating the kick intermediate shafts 151 and 155 to avoid an enlargement of the engine 20.

The kick drive gear 147 mounted on the kick shaft 38 and the shift-type gear (kick starter gear) 171 mounted on the second kick intermediate shaft 155 are arranged to be overlapped with each other from the side view (see FIG. 2). This makes it possible to reduce the longitudinal space and vertical space required for arranging those gears 147 and 171 to avoid enlargement of the engine 20.

Figure 6:
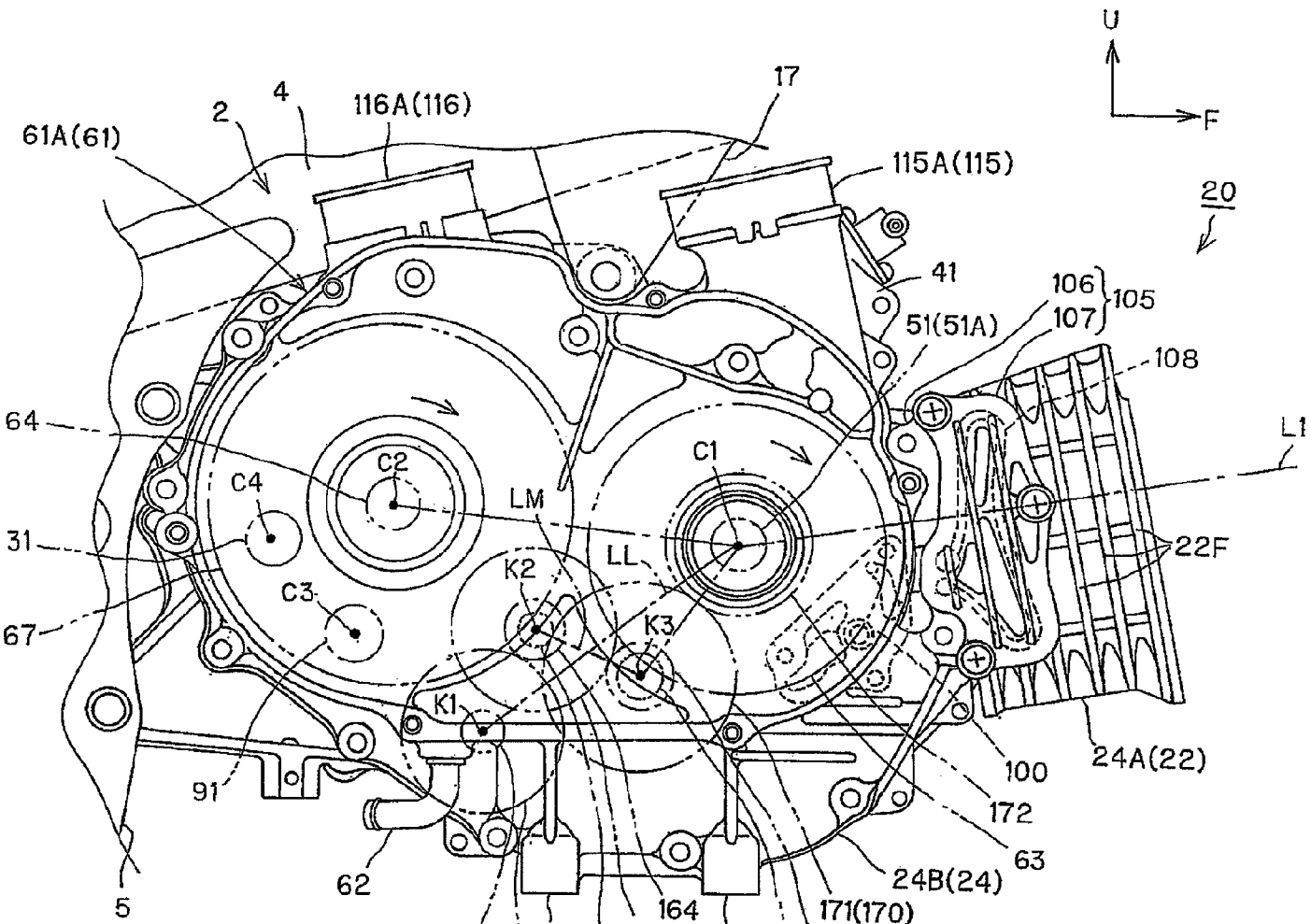
FIG. 6 is a view illustrating another embodiment of the present invention.

The output shaft 31 is disposed to the rear of the driven pulley shaft 64, and the intermediate gear shaft 91 as a spindle of the reduction gear of the power transmission mechanism 81 is located above the output shaft 31. The output shaft 31 may be disposed in the range except the upper side of the crankcase 24, which is generally considered as being appropriate in the space within the diameter of the driven pulley 67. In the structure in the embodiment illustrated in FIG. 6, the intermediate gear shaft 91 may be located below the driven pulley shaft 64 between the output shaft 31 and the kick shaft 38, thus ensuring the layout flexibility of the intermediate gear shaft 91. In the aforementioned case, the space between the output shaft 31 and the kick shaft 38 may be efficiently used, and the case breather with large capacity may also be disposed in the space above the driven pulley shaft 64. The output shaft 31 may be disposed below the driven pulley shaft 64, thus ensuring sufficient layout flexibility of the intermediate gear shaft 91 and the output shaft 31.

In the above-described structure, the kick shaft 38 is located inside the oil sump at the lower portion of the crankcase 24 so as to be easily lubricated with oil.

Figure 7:
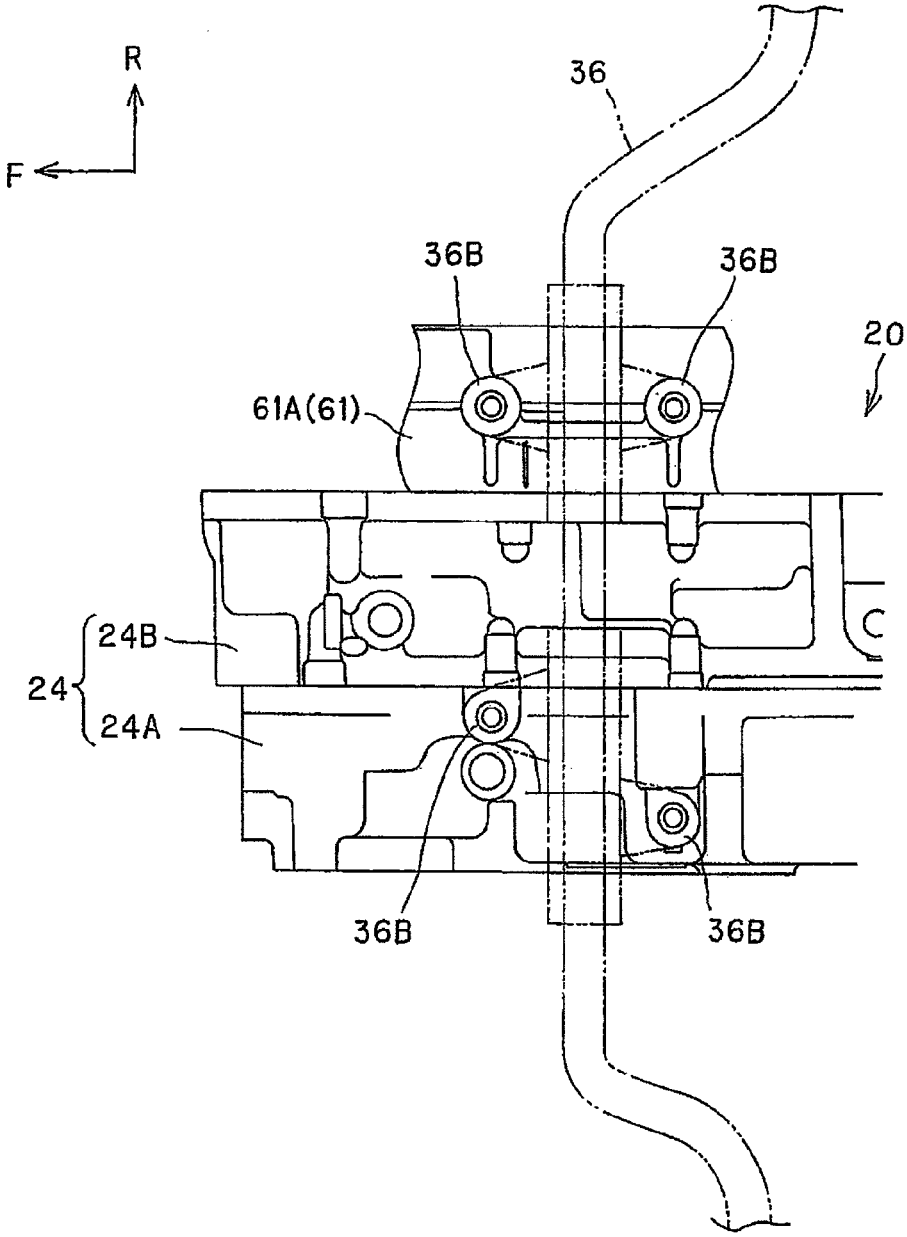
FIG. 7 is a view of the engine seen from the bottom.

FIG. 7 is a view of the engine 20 seen from the bottom. As described above, the crankcase 24 of the engine 20 is formed of the left crankcase 24A and the right crankcase 24B. The transmission case 61A is connected to the right of the right crankcase 24B, which functions as the clutch case for covering the centrifugal clutch 80. The oil sump is formed at the lower portion of the transmission case 61A, and accordingly, the lower surfaces of the crankcase 24 and the transmission case 61A are on substantially the same level to form the bottom surface of the oil sump (see FIG. 2).

In the above-described structure, the oil sump of the crankcase 24 is provided with a pair of front and rear boss portions (step bar support portions) 36B which protrude downward, and the oil sump at the lower portion of the transmission case 61A is provided with a pair of front and rear boss portions (step bar support portions) 36B which protrude downward. A not shown flange bolt may be tightened to those boss portions 36B for attachment of the step bar 36 which extends in the lateral direction of the vehicle body.

This makes it possible to keep the supporting distance between the left and right sides of step bars 36 wider than the support structure only with the crankcase 24.

Hereinafter, an air-intake structure of the belt type continuously variable transmission 60 will be described.

Outer air is admitted into the transmission chamber R2, that is, the transmission storage section 61 such that the belt type continuously variable transmission 60 is cooled with the admitted outer air.

Referring to FIG. 2, an outer air inlet 115 is formed in the upper front portion of the transmission case 61A corresponding to the upper side of the drive pulley 63, and an outer air outlet 116 is formed in the upper rear portion of the transmission case 61A corresponding to the upper side of the driven pulley 67. The outer air inlet 115 and the outer air outlet 116 are formed at an interval in the longitudinal direction, and provided with duct portions 115A and 116A, respectively each having the rear portion raised to extend upward in parallel. Those duct portions are integrally formed with the transmission case 61A. A not shown duct is connected to the upper ends of the outer air inlet 115 and the outer air outlet 116, through which the outer air is allowed to flow therethrough. As illustrated in FIG. 2, a drain portion 62 is provided for discharging water inside the transmission case 61A (transmission chamber R2).

The fixed half-body 63A of the drive pulley 63 disposed inside the transmission storage section 61 is provided with a blower fin 63C which allows the drive pulley 63 to serve as the blower fan. When the blower fin 63C is rotated accompanied with the rotation of the drive pulley 63, the outer air is admitted from the outer air inlet 115 into the transmission chamber R2. The fixed half-body 67A of the driven pulley 67 in the transmission storage section 61 is also provided with a blower fin 67C which allows the driven pulley 67 to serve as the blower fan. The rotation of the blower fin 67C allows the outer air admitted from the outer air inlet 115 to be guided to the side of the driven pulley 67 inside the transmission chamber R2, and further discharged from the outer air outlet 116. The outer air flow directed from the drive pulley 63 to the driven pulley 67 is generated in the transmission chamber R2, thus forcibly cooling the belt type continuously variable transmission 60 with air.

The rotating directions of the drive pulley 63 and the driven pulley 67 are shown by arrow marks in FIG. 2. Each pulley rotates clockwise from the right side view to allow the outer air to be smoothly admitted from the outer air inlet 115, and smoothly discharged from the outer air outlet 116.

A gear damper 97 will be described hereinafter.

Figure 8:
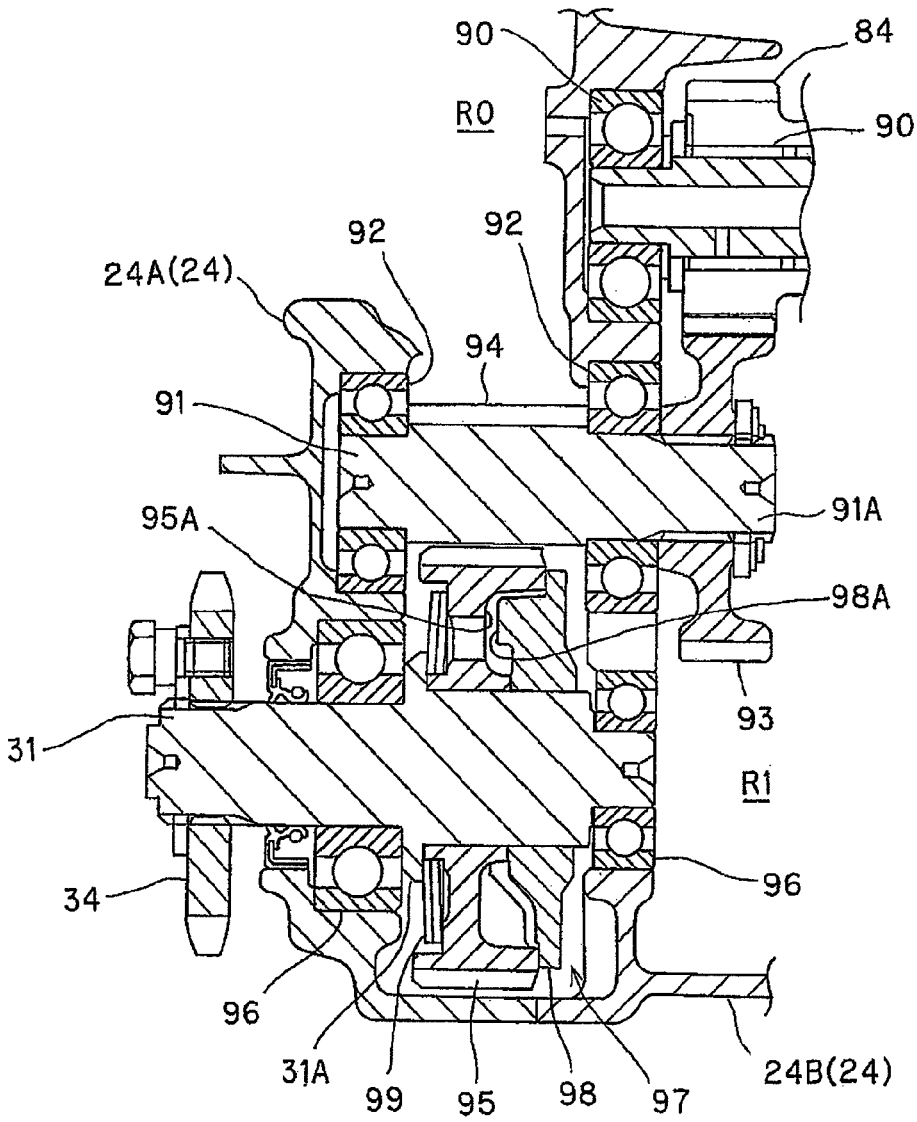
FIG. 8 is a view illustrating a gear damper and a peripheral structure.

FIG. 8 illustrates the gear damper 97 mounted on the output shaft 31 together with the peripheral structure.

The output shaft 31 is provided with a damper retainer member 98 adjacent to the right of the final gear 95. The damper retainer member 98 is press fit with the output shaft 31 for fixation so as to be rotated together with the output shaft 31.

The final gear 95 is rotatably retained with the output shaft 31. An extended diameter portion 31A as a spring seat is integrated with the output shaft 31 to the left of the final gear 95. A spring member (in the embodiment, plural disc springs) 99 is interposed between the extended diameter portion 31A and the left end surface of the final gear 95. The elastic force of the spring member 99 urges the final gear 95 against the damper retainer member 98.

Figure 9A:
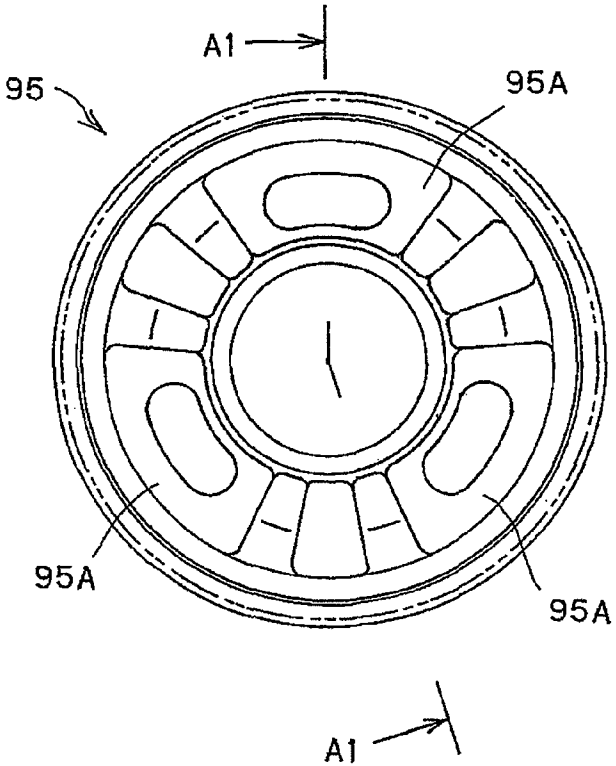
FIG. 9(A) is a side view of a final gear.
Figure 9B:
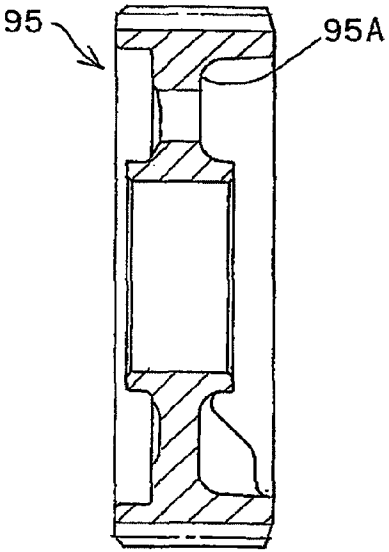
FIG. 9(B) is a sectional view taken along line A1-A1 of the final gear.
Figure 10B:
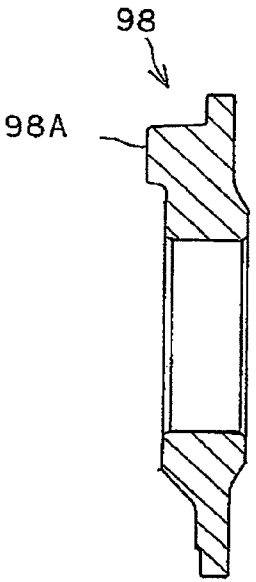
FIG. 10(B) is a sectional view taken along line A2-A2 of the damper retainer member.
Figure 10A:
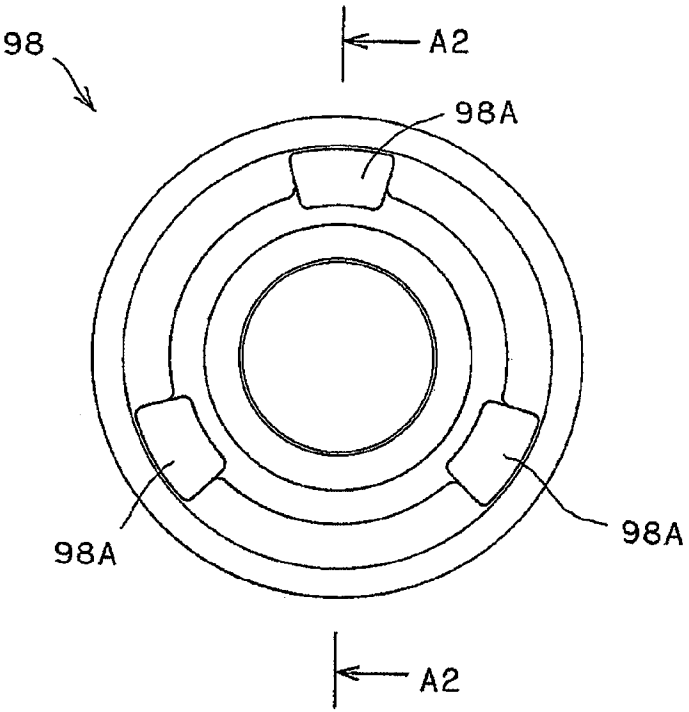
FIG. 10(A) is a side view of a damper retainer member.

FIG. 9(A) is a side view of the final gear 95, and FIG. 9(B) is a sectional view taken along line A1-A1 of the final gear 95. FIG. 10(A) is a side view of the damper retainer member 98, and FIG. 10(B) is a sectional view taken along line A2-A2 of the damper retainer member 98.

As FIGS. 9(A) to 10(B) a plurality of (three in the embodiment) concave cams 95A are formed on the surface of the final gear 95 at the side of the damper retainer member 98 at equal angular intervals. Convex cams 98A in mesh with the concave cams 95A are formed on the surface of the damper retainer member 98 at the side of the final gear 95.

In the case where the drive torque from the engine 20 is applied and the torque directed opposite the drive direction (so-called back torque) from the drive wheel (side of the rear wheel 15) is not applied, the concave cam 95A of the final gear 95 is in mesh with the convex cam 98A of the damper retainer member 98 such that the output shaft 31 is driven and rotated by the drive torque from the engine 20 for driving the rear wheel 15 as the drive wheel.

Meanwhile, in the case where the back torque is applied from the drive wheel side (side of the rear wheel 15), the convex cam 98A of the damper retainer member 98 slides along the circumferential direction with respect to the concave cam 95A of the final gear 95 against the elastic force of the spring member 99 to alleviate the transmission of the back torque to the engine 20. As a result, the cam type gear damper for absorbing the back torque from the drive wheel is disposed inside the crankcase 24.

Figure 11:
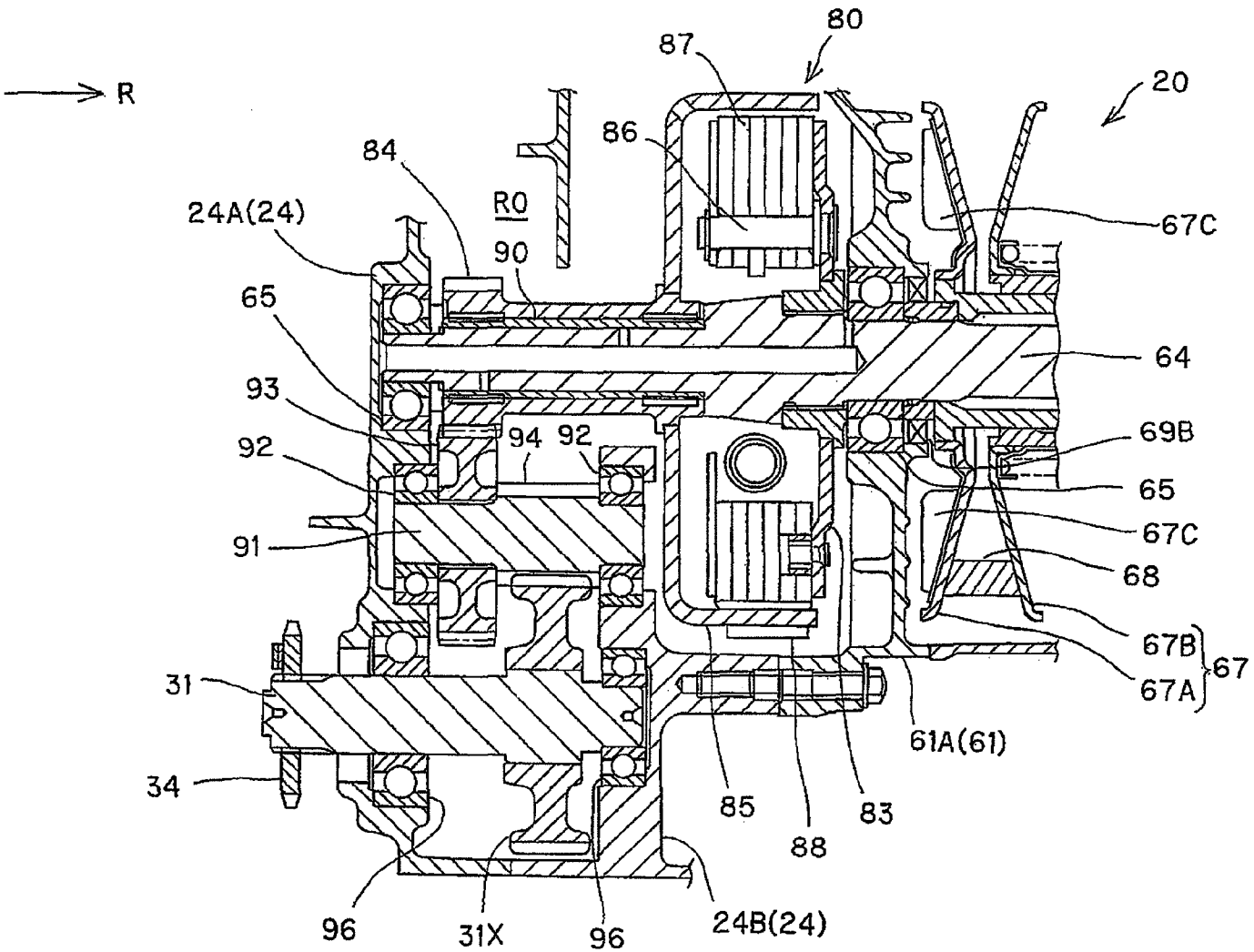
FIG. 11 is a view illustrating a modified example.

As has been described with respect to the embodiment of the present invention, it is to be understood that the present invention is not limited to the embodiment as described above. In the embodiment, the driven pulley shaft (driven shaft) 64 is supported with the pair of left and right bearings 65, 65 each disposed in the right crankcase 24B and the transmission case 61A, respectively. As an example in FIG. 11 shows, the left end of the right crankcase 24B is allowed to pierce the right crankcase 24B to further extend to the left so as to be supported with the bearing 65 disposed in the left crankcase 24A. In the aforementioned structure, the clutch output gear 84 mounted on the driven pulley shaft 64 is disposed in the left and the right crankcases 24A and 24B. Therefore, the intermediate shaft driven gear (reduction gear) 93 in mesh with the clutch output gear 84 is located in the left and right crankcases 24A and 24B, thus eliminating the member for preventing the intermediate shaft driven gear 93 from falling.

In the structure shown in FIG. 11, the output shaft 31 of the engine 20 is not provided with the gear damper 97. In addition, an output shaft gear 31X in mesh with the intermediate shaft drive gear 94 for transmitting the rotation of the intermediate shaft driven gear 93 to the output shaft 31 is press fit with or splined to the output shaft 31 so as to be driven and rotated. In this way, the design with respect to the use of the gear damper 97, position for supporting the driven pulley shaft (driven shaft) 64 and the like may be easily changed.

In the embodiment, the present invention is applied to a single cylinder engine. However, the present invention may be applied to a V-type engine having the respective cylinders arranged to define the predetermined angle, or the parallel type engine having the respective cylinders arranged in parallel.

In the embodiment, the present invention is applied to an internal combustion engine with a kick starter for a motorcycle. However, the present invention may be applied to the internal combustion engine with a kick starter to be employed for the vehicle other than the motorcycle.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An internal combustion engine with a kick starter, provided with a crankcase, a crankshaft supported by the crankcase, a transmission mounted on one side of the crankshaft, a generator mounted on another side of the crankshaft, and a power transmission mechanism for transmitting a rotation gear shifted by the transmission to an output shaft supported by the crankcase, in which the transmission includes a drive pulley mounted on one side of the crankshaft, a driven pulley mounted on one side of a driven shaft supported to a rear of the crankshaft, and a belt set between the drive pulley and the driven pulley, and the power transmission mechanism is provided with a reduction gear for decelerating the rotation of the driven shaft to be transmitted to the output shaft, a kick shaft which extends from the other side into the crankcase, and a kick starter for rotating the crankshaft with the kick shaft;

wherein the output shaft is disposed at a position overlapped with the driven pulley from a side view, and the power transmission mechanism is disposed between the output shaft and the driven shaft in the crankcase, wherein the kick shaft is disposed at a position below and forward of the driven shaft, which is not overlapped with the driven pulley from the side view, and a kick intermediate shaft is disposed between the kick shaft and the crankshaft to mount the kick starter on the crankcase, and wherein a spindle of the reduction gear which forms the power transmission mechanism is interposed between the output shaft and the kick shaft.

2. The internal combustion engine with a kick starter according to claim 1, wherein the kick intermediate shaft includes a first kick intermediate shaft provided with a kick driven gear in mesh with a kick drive gear mounted on the kick shaft and a first idle gear, and a second kick intermediate shaft provided with a second idle gear in mesh with the first idle gear and a kick starter gear in mesh with the crankshaft; and a line for connecting the kick shaft and the crankshaft intersects a line for connecting the first kick intermediate shaft and the second kick intermediate shaft from the side view.

3. The internal combustion engine with a kick starter according to claim 2, wherein the kick drive gear and the kick starter gear are disposed to be overlapped with each other from the side view.

4. The internal combustion engine with a kick starter according to claim 2, wherein the second kick intermediate shaft is located sideways to a rear of the crankshaft at a position that is not overlapped with the driven pulley, said second kick intermediate shaft being longer relative to the first kick intermediate shaft for extending through an opening formed in a wall portion of a right crankcase while having a left end portion supported with a left crankcase with an extended shaft portion being journaled to a transmission case.

5. The internal combustion engine with a kick starter according to claim 1, wherein the output shaft is disposed to a rear of the driven shaft and a spindle of the reduction gear which forms the power transmission mechanism is located above the output shaft.

6. The internal combustion engine with a kick starter according to claim 1, wherein an oil sump which extends downward is formed at a lower portion of the crankcase, and the kick shaft is disposed in the oil sump.

7. The internal combustion engine with a kick starter according to claim 6, wherein a clutch is interposed between the crankcase and the transmission;

an oil sump is formed at a lower portion of the transmission case for covering the clutch; and a step bar support portion for supporting a step bar is supported with the oil sumps of the crankcase and the transmission case.

8. The internal combustion engine with a kick starter according to claim 1, and further including a starter motor operatively connected to the internal combustion engine for selectively starting the engine.

9. The internal combustion engine with a kick starter according to claim 1, wherein the kick shaft is mounted to the crankcase with a bearings disposed therebetween with a kick drive gear being mounted on said kick shaft and a return biasing mechanism being in engagement with the kick shaft for urging the kick shaft towards a return position after the kick shaft is actuated to start the engine.

10. An internal combustion engine with a kick starter comprising:

a crankcase;

a crankshaft supported by the crankcase;

a power transmission mechanism for transmitting a rotation from a gear shifted by a transmission to an output shaft supported by the crankcase, in which the transmission includes a drive pulley mounted on one side of the crankshaft, a driven pulley mounted on one side of a driven shaft supported to a rear of the crankshaft and a belt set between the drive pulley and the driven pulley, said power transmission mechanism being provided with a reduction gear for decelerating the rotation of the driven shaft to be transmitted to the output shaft;

a kick shaft extending from the other side into the crankcase;

a kick starter for rotating the crankshaft with the kick shaft;

wherein the output shaft is disposed at a position overlapped with the driven pulley from a side view, and the power transmission mechanism is disposed between the output shaft and the driven shaft in the crankcase; and the kick shaft is disposed at a position below and forward of the driven shaft, which is not overlapped with the driven pulley from the side view, and a kick intermediate shaft is disposed between the kick shaft and the crankshaft to mount the kick starter on the crankcase.

11. The internal combustion engine with a kick starter according to claim 10, wherein the kick intermediate shaft includes a first kick intermediate shaft provided with a kick driven gear in mesh with a kick drive gear mounted on the kick shaft and a first idle gear, and a second kick intermediate shaft provided with a second idle gear in mesh with the first idle gear and a kick starter gear in mesh with the crankshaft; and a line for connecting the kick shaft and the crankshaft intersects a line for connecting the first kick intermediate shaft and the second kick intermediate shaft from the side view.

12. The internal combustion engine with a kick starter according to claim 11, wherein the second kick intermediate shaft is located sideways to a rear of the crankshaft at a position that is not overlapped with the driven pulley, said second kick intermediate shaft being longer relative to the first kick intermediate shaft for extending through an opening formed in a wall portion of a right crankcase while having a left end portion supported with a left crankcase with an extended shaft portion being journaled to a transmission case.

13. The internal combustion engine with a kick starter according to claim 11, wherein the kick drive gear and the kick starter gear are disposed to be overlapped with each other from the side view.

14. The internal combustion engine with a kick starter according to claim 10, wherein the output shaft is disposed to a rear of the driven shaft, and a spindle of the reduction gear which forms the power transmission mechanism is located above the output shaft.

15. The internal combustion engine with a kick starter according to claim 10, wherein a spindle of the reduction gear which forms the power transmission mechanism is interposed between the output shaft and the kick shaft.

16. The internal combustion engine with a kick starter according to claim 10, wherein an oil sump which extends downward is formed at a lower portion of the crankcase, and the kick shaft is disposed in the oil sump.

17. The internal combustion engine with a kick starter according to claim 16, wherein a clutch is interposed between the crankcase and the transmission;

an oil sump is formed at a lower portion of the transmission case for covering the clutch; and a step bar support portion for supporting a step bar is supported with the oil sumps of the crankcase and the transmission case.

18. The internal combustion engine with a kick starter according to claim 10, and further including a starter motor operatively connected to the internal combustion engine for selectively starting the engine.

19. The internal combustion engine with a kick starter according to claim 10, wherein the kick shaft is mounted to the crankcase with a bearings disposed therebetween with a kick drive gear being mounted on said kick shaft and a return biasing mechanism being in engagement with the kick shaft for urging the kick shaft towards a return position after the kick shaft is actuated to start the engine.

* * * * *